US009105412B2

(12) United States Patent
Inaba et al.

(10) Patent No.: US 9,105,412 B2
(45) Date of Patent: Aug. 11, 2015

(54) ELECTRICAL CONTACT FOR RELAY AND METHOD OF MANUFACTURING THEREFOR

(75) Inventors: Akihiko Inaba, Susono (JP); Noriaki Murahashi, Susono (JP); Masayuki Shibuta, Susono (JP); Yasuhiro Sekino, Susono (JP); Takahiro Yamada, Susono (JP)

(73) Assignee: MITSUBISHI MATERIALS C.M.I. CORPORATION, Shizuoka (JP)

( * ) Notice: Subject to any disclaimer, the term of this patent is extended or adjusted under 35 U.S.C. 154(b) by 370 days.

(21) Appl. No.: 13/497,632

(22) PCT Filed: Oct. 15, 2010

(86) PCT No.: PCT/JP2010/006147

§ 371 (c)(1),
(2), (4) Date: Mar. 22, 2012

(87) PCT Pub. No.: WO2011/045943

PCT Pub. Date: Apr. 21, 2011

(65) Prior Publication Data

US 2012/0175148 A1 Jul. 12, 2012

(30) Foreign Application Priority Data

Oct. 18, 2009 (JP) ..... 2009-239930

(51) Int. Cl.

| | |
|---|---|
| ***H01R 4/00*** | (2006.01) |
| ***H01H 1/0237*** | (2006.01) |
| ***H01H 50/54*** | (2006.01) |
| *H01H 11/04* | (2006.01) |

(52) U.S. Cl.
CPC ..... *H01H 1/0237* (2013.01); *H01H 50/54* (2013.01); *H01H 1/02372* (2013.01); *H01H 11/041* (2013.01)

(58) Field of Classification Search
CPC ..... H01H 11/04
USPC ..... 174/126.2, 94 R
See application file for complete search history.

(56) References Cited

U.S. PATENT DOCUMENTS

| | | | | |
|---|---|---|---|---|
| 3,258,829 | A * | 7/1966 | Gwyn, Jr. | 29/875 |
| 3,574,570 | A * | 4/1971 | Gwyn, Jr. | 428/650 |
| 3,799,771 | A * | 3/1974 | Harada | 148/431 |
| 2005/0028896 | A1 * | 2/2005 | Uemura et al. | 148/431 |

FOREIGN PATENT DOCUMENTS

| | | |
|---|---|---|
| JP | 51-134873 | 11/1976 |
| JP | 5-282958 | 10/1993 |
| JP | 2006-100003 | 4/2006 |
| JP | 1823176 | 8/2006 |
| JP | 101217075 | 7/2008 |
| WO | 2005/007907 | 1/2005 |

* cited by examiner

*Primary Examiner* — Chau N Nguyen
(74) *Attorney, Agent, or Firm* — Fay Kaplun & Marcin, LLP

(57) ABSTRACT

A rivet-shaped electrical contact for relay is used as a movable contact for the relay. The rivet-shaped electrical contact includes a heavy-load contact portion formed of a first silver-oxide type contact material; and a light-load contact portion formed of a second silver-oxide type contact material. The hardness of the first silver-oxide type contact material is set to be higher than that of the second silver-oxide type contact material.

5 Claims, 2 Drawing Sheets

ELECTRICAL CONTACT FOR RELAY AND METHOD OF MANUFACTURING THEREFOR

BACKGROUND OF THE INVENTION

1. Field of the Invention

The present invention relates to an electrical contact for relay suitable for, for example, vehicle-mounted relay or the like and a method for manufacturing the same.

2. Description of the Related Art

In general, a vehicle-mounted electromagnetic relay used in a motor load circuit or the like has a structure in which a pair of fixed contacts, i.e., a normal-open side (hereinafter referred to as "NO-side") fixed contact and a normal-close side (hereinafter referred to as "NC-side") fixed contact is arranged so as to sandwich a movable contact, and has a function of switching two electrical circuits by alternately contacting a movable contact with two fixed contacts.

For example, for an electromagnetic relay for switching ON/OFF of a wiper driving motor, wearing resistance characteristics and welding resistance characteristics for a motor drive current which is a large load current are required for the NO-side contact pair, and characteristics for suppressing a material transition projection to be formed by a motor braking circuit are required for the NC-side contact pair. The direction of the rotation of a motor is switched using electromagnetic relays in pairs so as to open/close a power window. Also in this case, wearing resistance characteristics and welding resistance characteristics are required for the NO-side contact pair, and characteristics for suppressing the formation of a material transition projection are required for the NC-side contact pair.

In particular, in a hinge-type electromagnetic relay for general purpose, the contact force at the contact of the NC-side contact pair cannot be principally increased as compared with that of the NO-side contact pair, and thus, the contact chattering occurs at the NC-side contact pair many number of times for a long time. Consequently, the amount of contact transition caused by a short-arc generated during the contact chattering increases, and thus, a contact locking occurs due to transition projections and holes generated in the NC-side contact pair, which may cause malfunction of the electromagnetic relay. In order to solve the problems, the contact hardness of the NC-side contact pair needs to be made lower than that of the NO-side contact pair.

As described in these examples, since the characteristics required for the NO-side contact pair are different from that required for the NC-side contact pair in the application of an electromagnetic relay often used in vehicles, it is preferable that a contact material suitable for each of the contact pairs be selected.

For this reason, conventionally, Patent Document 1 discloses a method for manufacturing a rivet-shaped clad electrical contact in which a silver-cadmium type unoxidized material or a silver-tin type unoxidized material and a silver or a silver-3-15% by weight of nickel alloy are cold welded and molded into a rivet shape, and the resulting material is then subjected to oxidization by heating in a pressurized oxygen atmosphere of 3 atm or higher at a temperature of 600° C. to 850° C. to thereby oxidize the silver-cadmium type unoxidized material or the silver-tin type unoxidized material to the silver-cadmium oxide type oxidized material or the silver-tin oxide type oxidized material.

In this technology, an electrical contact manufactured as described above is attached to a transfer type electrical contactor. By doing so, even when such electrical contact is used under the condition that large amount of current flows through one of the contact pairs and small amount of current flows through the other one, welding and wearing of a large-amount-of-current-side contact pair are suppressed, and contact resistance of a small-amount-of-current-side contact pair is small so as to ensure stable contact and conduction.

PRIOR ART DOCUMENTS

Patent Documents

[Patent Document 1] Japanese Unexamined Patent Publication No. 05-282958

SUMMARY OF THE INVENTION

Problems to be Solved by the Invention

The following problems still remain in the conventional techniques described above. In recent years, as a vehicle-mounted electromagnetic relay has been reduced in size, the dimensions of a contact have decreased while there has been a tendency for current flowing through a circuit to increase. Consequently, the load acting on a contact is relatively high, and thus, high durability is required for the contact. In order to satisfy such need, a contact having a structure such that an optimum contact material is selectable for each of the NO-side contact pair and the NC-side contact pair is required. However, the electrical contact disclosed in Patent Document 1 is difficult to satisfy high durability required for a contact for vehicle-mounted electromagnetic relay used in recent years.

The present invention has been made in view of the above problems, and it is an object of the present invention to provide an electrical contact for relay and a manufacturing method for the same, wherein, when different electrical contact characteristics are required for opening/closing two electrical circuits, an optimum combination of contact materials in accordance with the states of each of the electrical contact loads is readily made, and high electrical contact reliability is achieved.

Means for Solving the Problems

The present invention adopts the following configuration in order to solve the problems. More specifically, the electrical contact for relay of the present invention is a rivet-shaped electrical contact for relay, which is used as a movable contact for the relay, including a heavy-load contact portion formed of a first silver-oxide type contact material; and a light-load contact portion formed of a second silver-oxide type contact material, wherein the hardness of the first silver-oxide type contact material is set to be higher than that of the second silver-oxide type contact material.

The method for manufacturing an electrical contact for relay of the present invention is a method for manufacturing a rivet-shaped electrical contact for relay, which is used as a movable contact for the relay, including cold-welding a first silver-oxide type contact material for use as a heavy-load contact portion and a second silver-oxide type contact material for use as a light-load contact portion directly or via another metal material and molding the resulting materials in the rivet-shape, wherein the hardness of the first silver-oxide type contact material is set to be higher than that of the second silver-oxide type contact material.

In the electrical contact for relay of the present invention and the method for manufacturing the same of the present invention, the hardness of the first silver-oxide type contact material is set to be higher than that of the second silver-oxide type contact material. Thus, an optimum combination of contact materials in accordance with the states of each of the electrical contact loads is readily made by bringing two silver-oxide type contact materials having different hardness into combination, and high electrical contact reliability for electromagnetic relay is achieved. More specifically, a silver-oxide type contact material having high hardness is used in a heavy-load contact portion such as a NO-side contact or the like, and thus, welding resistance and contact wearing resistance can be maintained for high load current. In addition, a silver-oxide type contact material having low hardness is used in a light-load contact portion such as a NC-side contact or the like, and thus, the contact chattering is reduced. Consequently, the probability of the occurrence of arc decreases and the amount of contact transition decreases, whereby contact reliability for a small-sized electromagnetic relay or the like can be improved for greater electrical contact load.

Also, the method for manufacturing an electrical contact for relay of the present invention is characterized in that, during the cold-welding, a metal material exhibiting a higher welding strength than that obtained when the first silver-oxide type contact material is directly welded to the second silver-oxide type contact material is arranged between the first silver-oxide type contact material and the second silver-oxide type contact material so as to form an intermediate layer formed of the metal material between the heavy-load contact portion and the light-load contact portion.

More specifically, in the method for manufacturing an electrical contact for relay of the present invention, an intermediate layer formed of a metal material exhibiting a higher welding strength than that obtained when the first silver-oxide type contact material is directly welded to the second silver-oxide type contact material is formed between the heavy-load contact portion and the light-load contact portion. Thus, the first silver-oxide type contact material and the second silver-oxide type contact material can be welded by sandwiching the intermediate layer so as to obtain a higher welding strength than that obtained when silver-oxide type contact materials, which are difficult in obtaining high welding strength, are directly welded to each other.

Also, the electrical contact for relay of the present invention is characterized in that an intermediate layer formed of copper is formed between the heavy-load contact portion and the light-load contact portion. Furthermore, the method for manufacturing an electrical contact for relay of the present invention is characterized in that a metal material for forming the intermediate layer is copper.

More specifically, in the electrical contact for relay of the present invention and the method for manufacturing the same of the present invention, an intermediate layer formed of copper is formed between the heavy-load contact portion and the light-load contact portion. Thus, the amount of an expensive silver-oxide type contact material can be minimized as required by replacing the material used for the intermediate layer, which is not directly used for contact, with relatively inexpensive copper, resulting in a reduction in raw material costs.

Effects of the Invention

According to the present invention, the following effects may be provided. More specifically, according to the electrical contact for relay of the present invention and the method for manufacturing the same of the present invention, the hardness of the first silver-oxide type contact material is set to be higher than that of the second silver-oxide type contact material. Thus, welding resistance and wearing resistance can be maintained in the heavy-load contact portion such as the NO-side contact or the like, and the effects of suppressing the formation of a material transition projection can be obtained in the light-load contact portion such as the NC-side contact or the like. Therefore, the electrical contact for relay of the present invention is preferably used as an electrical contact used in a small-sized and vehicle-mounted electromagnetic relay or the like.

DESCRIPTION OF THE EMBODIMENTS

Figure 1:
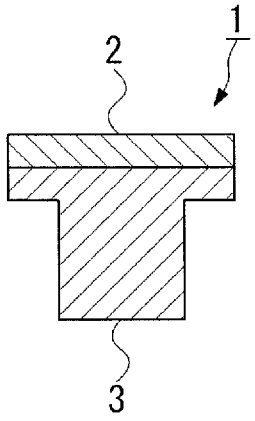
FIG. 1 is a cross-sectional view illustrating an electrical contact for relay according to a first embodiment of the electrical contact for relay and the method for manufacturing the same of the present invention.

Hereinafter, a description will be given of an electrical contact for relay and a method for manufacturing the same according to the first embodiment of the present invention with reference to FIG. 1.

The electrical contact for relay (1) of the present embodiment is a rivet-shaped electrical contact for relay, which is used as a movable contact for a vehicle-mounted electromagnetic relay for switching the load of, for example, an intermittent wiper or a power window. As shown in FIG. 1, the electrical contact for relay (1) has a heavy-load contact portion (2) formed of a first silver-oxide type contact material, and a light-load contact portion (3) formed of a second silver-oxide type contact material.

Examples of the first silver-oxide type contact material and the second silver-oxide type contact material include a silver-tin oxide type contact material, a silver-tin oxide-indium oxide type contact material, a silver-copper oxide type contact material, and the like, which are conventionally known. Also, the hardness of the first silver-oxide type contact material is set to be higher than that of the second silver-oxide type contact material.

The heavy-load contact portion (2) is provided at the head of the rivet-shaped electrical contact for relay (1) and functions as the NO-side contact. The light-load contact portion (3) is provided at the foot of the rivet-shaped electrical contact for relay (1) and is used as the NC-side contact. More specifically, the electrical contact for relay (1) of the present embodiment is constituted by a combination of two kinds of silver-oxide type contact materials having different hardness at the head and the foot thereof.

The first silver-oxide type contact material for use as the heavy-load contact portion (2) is cold-welded to the second silver-oxide type contact material for use as the light-load contact portion (3) using a header machine, and the resulting materials are molded in a rivet-shape. Consequently, the rivet-shaped electrical contact for relay (1) is manufactured. During cold-welding, the hardness of the first silver-oxide type contact material is set to be higher than that of the second silver-oxide type contact material.

In the electrical contact for relay (1) and the method for manufacturing the same of the present embodiment, the hardness of the first silver-oxide type contact material is set to be higher than that of the second silver-oxide type contact material. Thus, an optimum combination of contact materials in accordance with the states of each of the electrical contact loads is readily made by bringing two kinds of silver-oxide type contact materials having different hardness into combination, and high electrical contact reliability for electromagnetic relay is achieved.

More specifically, a silver-oxide type contact material having high hardness is used in a heavy-load contact portion (2) of a NO-side contact, and thus, welding resistance and wearing resistance can be maintained for high load current. In addition, a silver-oxide type contact material having low hardness is used in a light-load contact portion (3) of a NC-side contact, and thus, the contact chattering is reduced. Consequently, the probability of the occurrence of arc decreases and the amount of contact transition decreases, whereby contact reliability for a small-sized electromagnetic relay or the like can be improved for greater electrical contact load.

Next, a description will be given of an electrical contact for relay and a method for manufacturing the same according to the second embodiment of the present invention with reference to FIG. 2. In the following description, the same elements as those described in the aforementioned embodiment are designated by the same reference numerals and explanation thereof will be omitted.

Figure 2:
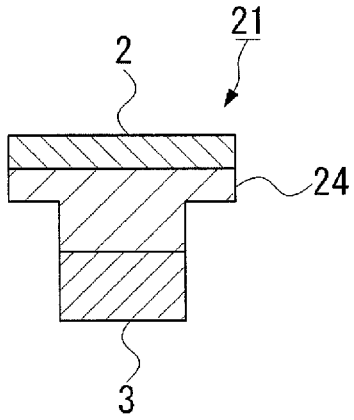
FIG. 2 is a cross-sectional view illustrating an electrical contact for relay according to a second embodiment of the electrical contact for relay and the method for manufacturing the same of the present invention.

While, in the first embodiment, the heavy-load contact portion (2) formed of the first silver-oxide type contact material is directly welded to the light-load contact portion (3) formed of the second silver-oxide type contact material, the second embodiment is different from the first embodiment in that an electrical contact for relay (21) of the second embodiment is constituted by the heavy-load contact portion (2) and the light-load contact portion (3) by sandwiching an intermediate layer (24) formed of copper as shown in FIG. 2.

More specifically, in the second embodiment, the heavy-load contact portion (2) is welded to the light-load contact portion (3) via the intermediate layer (24) formed of copper. During the cold-welding, a metal material, i.e., copper exhibiting a higher welding strength than that obtained when the first silver-oxide type contact material is directly welded to the second silver-oxide type contact material is arranged between the first silver-oxide type contact material and the second silver-oxide type contact material so as to form an intermediate layer formed of copper between the heavy-load contact portion (2) and the light-load contact portion (3). Thus, the electrical contact for relay (21) of the second embodiment is manufactured.

As described above, in the electrical contact for relay (21) of the second embodiment, the intermediate layer (24) formed of a metal material, i.e., copper exhibiting a higher welding strength than that obtained when the first silver-oxide type contact material is directly welded to the second silver-oxide type contact material is formed between the heavy-load contact portion (2) and the light-load contact portion (3). Thus, the first silver-oxide type contact material and the second silver-oxide type contact material can be welded by sandwiching the intermediate layer (24) so as to obtain a higher welding strength than that obtained when silver-oxide type contact materials, which are difficult in obtaining high welding strength, are directly welded to each other. In addition, the intermediate layer (24) formed of copper is formed between the heavy-load contact portion (2) and the light-load contact portion (3). Thus, the amount of an expensive silver-oxide type contact material can be minimized as required by replacing the material used for the intermediate layer (24), which is not directly used for contact, with relatively inexpensive copper, resulting in a reduction in raw material costs.

Example 1

Next, a description will be given of the results of evaluation of the electrical contact for relay of the present invention practically manufactured by the manufacturing method of the first embodiment.

In Example 1, the electrical contact for relay of the present invention was manufactured by the following steps. First, silver-tin oxide-indium oxide type contact materials (a), (b), and (c) with the contents of oxides of 6%, 10%, and 17% by weight, respectively, and a silver-10% by weight of nickel contact material (d), all of which having the composition as shown in Table 1, were manufactured and processed to obtain wires having a diameter of 1.4 mm.

TABLE 1

| MATERIAL NOTATION | COMPOSITION OF MATERIAL (% BY WEIGHT) TIN OXIDE | INDIUM OXIDE | OTHER OXIDES | SILVER + IMPURITIES | HARDNESS (HV) |
|---|---|---|---|---|---|
| a | 4 | 1.5 | 0.5 | 94 | 79 |
| b | 7.5 | 2 | 0.5 | 90 | 86 |
| c | 12 | 4 | 1 | 83 | 115 |

| MATERIAL NOTATION | COMPOSITION OF MATERIAL (% BY WEIGHT) NICKEL | SILVER + IMPURITIES | HARDNESS (HV) |
|---|---|---|---|
| d | 10 | 90 | 60 |

Two out of three wires of the silver-tin oxide-indium oxide type contact materials (a), (b), and (c) were combined. Each of two-combined wires was welded using a heading machine, and molded into a rivet-shaped electrical contact at the same time. Consequently, composite movable contacts (electrical contacts for relay) No. 1 and No. 2 in Example of the present invention shown in Table 2 were obtained.

TABLE 2

| | CONTACT NUMBER | HEAD CONTACT MATERIAL | FOOT CONTACT MATERIAL |
|---|---|---|---|
| COMPOSITE MOVABLE CONTACT OF THE PRESENT INVENTION | No. 1 | c | a |
| | No. 2 | c | b |
| SOLID MOVABLE CONTACT | No. 3 | a | |
| | No. 4 | b | |
| | No. 5 | c | |
| CONVENTIONAL COMPOSITE MOVABLE CONTACT | No. 6 | c | d |

More specifically, in the composite movable contacts No. 1 and No. 2 of the present invention, the heavy-load contact portion (2) of the head portion was formed of the silver-tin oxide-indium oxide type contact material (c) having a micro-Vickers hardness of 115 HV used as the first silver-oxide type contact material, and the light-load contact portion (3) of the foot portion was formed of the silver-tin oxide-indium oxide type contact materials (a) and (b) having a low micro-Vickers hardness of 79 HV and 86 HV, respectively, used as the second silver-oxide type contact material. The size of the electrical contact in Example 1 had a head diameter of 2.5 mm, a head thickness of 0.4 mm, a thickness of a contact material of 0.2 mm, a foot diameter of 1.5 mm, a foot length of 1.0 mm, and a contact surface R of 12 mm.

For comparison, solid movable contacts No. 3 to No. 5 using wires of the silver-tin oxide-indium oxide type contact materials (a), (b), and (c) were manufactured. Furthermore, a conventional composite movable contact No. 6, which was formed of the wire of the silver-tin oxide-indium oxide type contact material (c) and the wire of the silver-10% by weight of nickel contact material (d) in combination with each other, was manufactured as described in the prior art. Furthermore, solid fixed contacts were manufactured using the wires of the contact materials (a), (b), (c), and (d). The size of each of these fixed contacts had a head diameter of 2.5 mm, a head thickness of 0.4 mm, a foot diameter of 1.5 mm, and a foot length of 1.0 mm.

Each of the composite movable contacts (Example 1) of the present invention, the solid movable contacts, and the conventional composite movable contact, all of which were manufactured as described above, was crimped to a movable metal base, and each of the solid fixed contacts was caulked to a fixed metal base. Then, a movable contact and a fixed contact in combination as shown in Table 3 were built into each of electromagnetic relays (1) to (6) for evaluation. Then, an opening/closing durability test was performed under the following condition using the electromagnetic relays for evaluation.

<Electrical Test Condition>

Power supply voltage: DC 14V

Load: (A) power window motor free, (B) power window motor lock

Load current: motor lock current 30 A

Contact force at NO-side contact: 27 g

Contact force at NC-side contact: 12 g

Relay for evaluation: 1c configuration, hinge type PCB relay

The results of durability test are shown in Table 3.

TABLE 3

| | CONTACT CONFIGURATION | | | POWER WINDOW MOTOR FREE LOAD DURABILITY TEST | | POWER WINDOW MOTOR LOCK LOAD DURABILITY TEST | |
|---|---|---|---|---|---|---|---|
| RELAY NUMBER | MOVABLE CONTACT | NO-SIDE FIXED CONTACT MATERIAL | NC-SIDE FIXED CONTACT MATERIAL | DURABILITY NUMBER OF OPENING/CLOSING TIMES ($\times 10^3$ TIMES) | FAILURE MODE | DURABILITY NUMBER OF OPENING/CLOSING TIMES ($\times 10^3$ TIMES) | FAILURE MODE |
| (1) | No. 1 | c | a | 329 | NC-side LOCKING | 308 | NO-side WELDING |
| (2) | No. 2 | c | b | 386 | NO-side WELDING | 285 | NO-side WELDING |
| (3) | No. 3 | a | a | 11 | NO-side WELDING | 7 | NO-side WELDING |
| (4) | No. 4 | b | b | 27 | NO-side WELDING | 12 | NO-side WELDING |
| (5) | No. 5 | c | c | 108 | NC-side LOCKING | 146 | NC-side LOCKING |
| (6) | No. 6 | c | d | 142 | NC-side LOCKING | 154 | NC-side LOCKING |

For practical application, the relay needs to have durability such that a number of times the relay can be opened/closed is approximately two hundred thousand or greater. It can be seen from the results that the relays (1) and (2) using the composite movable contact No. 1 and No. 2 of the present invention in Example 1, respectively, has high durability sufficient for practical application as compared with the relays using the solid movable contacts or the conventional composite movable contact. The contact chattering at the NC-side of each of the electromagnetic relays (1) and (2) mounting the composite movable contacts No. 1 and No. 2 of the present invention in Example 1, respectively, was significantly small as compared with the electromagnetic relay (5) mounting the solid movable contact No. 5. In addition, the contact transition amount was decreased. Among all movable contacts shown in Table 2, the movable contact of which the contact abrasion amount at the NO contact was small and the contact stability at the NC contact was the highest was the movable contact of the contact number No. 1 of Example 1. Then, the movable contact of the contact number No. 2 was the second.

As another Example of the electrical contact for relay of the second embodiment, a composite electrical contact in which an intermediate layer formed of copper was arranged was also evaluated in the same manner as that of Example 1, and the substantially same results as that of Example 1 were obtained.

The technical scope of the present invention is not limited to the aforementioned embodiments and Examples, but the present invention may be modified in various ways without departing from the scope or teaching of the present invention.

REFERENCE NUMERALS

1, 21: electrical contact for relay, 2: heavy-load contact portion, 3: light-load contact portion, 24: intermediate layer

What is claimed is:

1. A rivet-shaped electrical contact for relay, which is used as a movable contact for the relay, the rivet-shaped electrical contact comprising:

a heavy-load contact portion formed of a first silver-oxide type contact material at a normal-open side; and a light-load contact portion formed of a second silver-oxide type contact material at a normal-close side, wherein the hardness of the first silver-oxide type contact material is set to be higher than that of the second silver-oxide type contact material.

2. The rivet-shaped electrical contact for relay according to claim 1, wherein an intermediate layer formed of copper is formed between the heavy-load contact portion and the light-load contact portion.

3. A method for manufacturing a rivet-shaped electrical contact for relay, which is used as a movable contact for the relay, the method comprising:

cold-welding a first silver-oxide type contact material for use as a heavy-load contact portion and a second silver-oxide type contact material for use as a light-load contact portion directly or via another metal material and molding the resulting materials in the rivet-shape, wherein the hardness of the first silver-oxide type contact material is set to be higher than that of the second silver-oxide type contact material.

4. The method for manufacturing a rivet-shaped electrical contact for relay according to claim 3, wherein, during the cold-welding, a metal material is arranged between the first silver-oxide type contact material and the second silver-oxide type contact material so as to form an intermediate layer between the heavy-load contact portion and the light-load contact portion, the metal material providing a higher welding strength than when the first silver-oxide type contact material is directly welded to the second silver-oxide type contact material.

5. The method for manufacturing a rivet-shaped electrical contact for relay according to claim 4, wherein a metal material for forming the intermediate layer is copper.

* * * * *